United States Patent [19]

Bacskai et al.

[11] Patent Number: 4,778,654

[45] Date of Patent: Oct. 18, 1988

[54] ALKYLANILINE/FORMALDEHYDE CO-OLIGOMERS AS CORROSION INHIBITORS

[75] Inventors: Robert Bacskai, Kensington; Albert H. Schroeder, Richmond, both of Calif.

[73] Assignee: Chevron Research Company, San Francisco, Calif.

[21] Appl. No.: 926,048

[22] Filed: Oct. 31, 1986

[51] Int. Cl.[4] ..... C23F 11/00; C23F 11/04

[52] U.S. Cl. ..... 422/7; 422/16; 252/8.555; 252/390; 252/393; 528/139; 528/129; 528/162; 528/269

[58] Field of Search ..... 252/8.555, 390, 393; 528/162, 269, 129, 137; 422/7, 16

[56] References Cited

U.S. PATENT DOCUMENTS

| | | | |
|---|---|---|---|
| 2,496,596 | 2/1950 | Moyer et al. | 252/8.555 |
| 2,882,171 | 4/1959 | Denman | 106/14.13 |
| 2,889,277 | 6/1959 | Hughes | 252/8.555 |
| 3,127,355 | 3/1964 | De Groote et al. | 252/392 |
| 3,436,373 | 4/1969 | Cox et al. | 525/507 |
| 3,959,158 | 5/1976 | Stanford et al. | 252/8.555 |
| 4,026,807 | 5/1977 | Quinlan et al. | 564/504 |
| 4,454,298 | 6/1984 | Koyama et al. | 528/137 |
| 4,500,691 | 2/1985 | Stockinger et al. | 525/503 |
| 4,529,682 | 7/1985 | Toukhy | 528/162 |
| 4,555,544 | 11/1985 | Meyer et al. | 528/137 |

FOREIGN PATENT DOCUMENTS 0001086 2/1984 PCT Int'l Appl. .

*Primary Examiner*—Paul Lieberman
*Assistant Examiner*—Ronald A. Krasnow
*Attorney, Agent, or Firm*—S. R. LaPaglia; R. C. Gaffney; C. J. Caroli

[57] ABSTRACT

A hydrocarbon-soluble corrosion inhibitor composition comprising the reaction product obtained by the acid-catalyzed oligomerization of alkylaniline, formaldehyde, and an aromatic compound selected from aniline, phenol, alkylphenol and an ethoxylated alkylphenol. Also disclosed is a method of inhibiting corrosion of a corrodible metal utilizing said composition.

32 Claims, No Drawings

ALKYLANILINE/FORMALDEHYDE CO-OLIGOMERS AS CORROSION INHIBITORS

BACKGROUND OF THE INVENTION

This invention relates to a hydrocarbon-soluble composition which is useful in inhibiting the corrosion of a corrodible metal material. More particularly, this invention relates to a hydrocarbon-soluble composition comprising the reaction product obtained by the acid-catalyzed oligomerization of an alkylaniline, formaldehyde and an aromatic compound. The invention further relates to a method of inhibiting corrosion in corrodible metals.

Corrosion inhibition in acid systems has been the subject of considerable interest in recent years. In industrial cleaning operations, where aqueous solutions of acid serve to remove scale and other deposits from metallic surfaces of industrial equipment, the inhibitors are used to reduce acid attack on the metals of construction during the cleaning operations. In processing operations where some acid is present or may be generated, inhibitors are introduced to reduce the corrosiveness of the acid. In oil well operations, corrosion inhibitors are introduced during various treatment stages and during secondary recovery operations. In all these operations, the corrosion inhibitor is in a form which is dispersible and preferably miscible in the liquid medium of the particular system.

Since the industrial equipment being protected by the inhibitor is often of considerable value or is often difficult and expensive to replace, significant importance has been given to the development of new and improved corrosion inhibitors. One area of such interest has been the organic inhibitors such as the amines, ketones, sulfides, acetylenic alcohols and the like. In respect to the amines or to their acid salts commonly formed in the acidic systems, fatty amines having one or more amine groups have been recognized as effective inhibitors. Rosin amines have also been used as corrosion inhibitors as have their oxyalkylated derivatives. In addition, various polymeric resins with amine functionalities have been used to some extent.

U.S. Pat. No. 3,770,377 discloses a method for preventing corrosion of metals by an acidic environment by utilizing a corrosion inhibitor which is the reaction product formed by reacting, in the liquid phase and under neutral conditions, at least one carbonyl compound and at least one amine containing a plurality of primary or secondary amino groups. Specific amines taught by this patent include hexamethylene diamine and 1,8-diaminonaphthalene. Specific carbonyl compounds employed include formaldehyde and cyclohexanone.

U.S. Pat. No. 4,554,090 discloses a combination corrosion and scale inhibitor composition comprising the reaction product of (a) a heterocyclic nitrogen containing compound selected from alkylpyridine, alkylpyrimidine, alkylimidazole, alkylimidazoline, quinoline and quinaldine, (b) an aldehyde and (c) a phosphoric acid constituent.

U.S. Pat. No. 3,977,981 discloses a method for inhibiting corrosion of corrodible metals utilizing a 14-membered or 16-membered macrocyclic tetramine.

U.S. Pat. No. 4,511,480 discloses a method of inhibiting corrosion of ferrous metals by employing a phosphate ester of an oxyalkylated thiol.

U.S. Pat. No. 4,089,789 discloses a method for inhibiting corrosion of ferrous metal in an acid system utilizing an oxyalkylated phenolic inhibitor comprising the reaction product of (a) an alkylene oxide and (b) a phenolic compound having two non-oxyalkylatable, saturated tertiaryamino alkylene groups.

SUMMARY OF THE INVENTION

The present invention provides a hydrocarbonsoluble corrosion inhibitor composition comprising the reaction product obtained by the acid-catalyzed oligomerization of (a) an alkylaniline having from 4 to 30 carbon atoms in the alkyl substituent, (b) formaldehyde, and (c) an aromatic compound selected from the group consisting of aniline, phenol, alkylphenol having from 6 to 30 carbon atoms in the alkyl substituent, and an ethoxylated alkylphenol of the formula

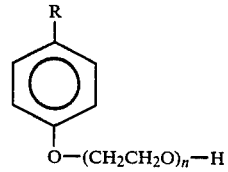

wherein R is alkyl of 6 to 24 carbon atoms, and n is an integer from 3 to 20.

The present invention further provides a method of inhibiting corrosion of a corrodible metal material which comprises contacting the metal material with an effective amount of the corrosion inhibitor composition of the invention.

The present invention is also concerned with a method of inhibiting corrosion of a corrodible metal material in or around a well through which a corrosive fluid is produced, which comprises contacting the metal material with an effective amount of the corrosion inhibitor composition of the invention.

Among other factors, the present invention is based on the discovery that the oligomeric polyamines obtained by the acid-catalyzed oligomerization of alkylaniline with formaldehyde and certain other aromatic compounds are excellent corrosion inhibitors in various environments. More particularly, the invention is based, in part, on the discovery that the presently described oligomers exhibit very good initial inhibition of metal corrosion in aqueous environments and this effect is surprisingly much more persistent than that observed for the corresponding monoamine starting material. Moreover, in an acidic environment, the oligomeric products of this invention show superior persistence in inhibiting corrosion when compared with known monoamine corrosion inhibitors, such as tallow amine. Advantageously, the present oligomers can be both hydrocarbon-soluble and water dispersible. Moreover, the water dispersibility of the present oligomers can be controlled by varying the type and amount of the additional aromatic compound, such as ethoxylated alkylphenol, included in the oligomerization reaction mixture.

DETAILED DESCRIPTION OF THE INVENTION

The oligomeric reaction products of the invention are prepared by the reaction of an alkylaniline with formaldehyde and an additional aromatic compound in the presence of an acid catalyst. In general, the alkyl side chain on the alkylaniline will contain from about 4 to 30 carbon atoms, preferably from 10 to 30 carbon atoms, and more preferably, from 12 to 24 carbon atoms. Examples of preferred alkylanilines include dodecylaniline and ($C_{20-24}$)-alkylaniline. The average molecular weight of the oligomeric reaction product will normally be in the range of about 500 to 10,000, preferably in the range of about 800 to 7000.

The alkylaniline starting material may be prepared from readily available alkylaromatic feedstocks. These alkylaromatic feedstocks are commonly obtained by the reaction of a suitable olefin with benzene. The olefins which are suitable for this reaction may be either straight chain, slightly branched or highly branched in structure. Straight chain olefins are normally obtained by the cracking of wax or from the ethylene growth reaction. Branched chain olefins are conveniently obtained by the polymerization of lower molecular weight olefins, such as propylene or isobutylene. The olefins which are particularly useful for preparing the alkylaromatic feedstocks are those having from 4 to 30 carbon atoms, preferably from 10 to 30 carbon atoms, and more preferably, from 12 to 24 carbon atoms. The alkylaromatic feedstocks are commercially available as detergent precursors.

The alkylbenzene compounds are then mononitrated with a nitric acid/sulfuric acid mixture, using conventional methods. The mononitrated alkylbenzene is subsequently reduced to the corresponding alkylaniline by catalytic hydrogenation, using procedures well known to the art.

Alternatively, the alkylaniline starting material may be prepared by the alkylation of aniline with an olefin, as disclosed in commonly assigned, copending U.S. patent application, Ser. No. 925,198, filed concurrently herewith, titled "Process for the Preparation of Alkylaniline Using a Friedel-Crafts Catalyst". According to this procedure, the desired alkylaniline is obtained by reacting aniline with an appropriate olefin in the presence of a Friedel-Crafts catalyst. Suitable Friedel-Crafts catalysts include aluminum chloride, boron trifluoride, boron trifluoride-etherate, boron trichloride, aluminum bromide, and the like. The preferred Friedel-Crafts catalyst is aluminum chloride. The amount of catalyst utilized will generally range from about 0.1 to 10 weight percent.

Suitable olefins for reaction with aniline may be either straight chain or branched chain in structure and are generally obtained by conventional procedures, such as wax cracking, the ethylene growth reaction and the polymerization of lower molecular weight olefins. Preferred olefins for reaction with aniline will normally contain about 10 to 30 carbon atoms. The molar ratio of olefin to aniline will normally range from about 1:10 to 10:1.

The Friedel-Crafts catalyzed reaction of aniline with an appropriate olefin will generally take place in a pressure reactor at a pressure in the range of about 40 psi to 500 psi. The reaction temperature will generally range from about 150° C. to about 350° C. The reaction will normally proceed over a period of about 0.5 to 8 hours. The resulting alkylaniline is then separated from the catalyst residue and unreacted starting materials, using conventional techniques.

A further alternative for preparing the alkylaniline starting material is by the alkylation of aniline with an olefin, as disclosed in commonly assigned, copending U.S. Patent Application Ser. No. 925,335, filed concurrently herewith, titled "Process for the Preparation of Alkylaniline Using an Aluminosilicate Catalyst". According to this procedure, the reaction of aniline with an olefin is carried out in the presence of an aluminosilicate catalyst. The aluminosilicate catalyst may be any of the well-known aluminosilicates, such as the crystalline aluminosilicate zeolites and the various aluminosilicate clays. In general, the aluminosilicates which are suitable for use in this process are those having a silica to alumina molar ratio in the range of about 3:1 to about 150:1, preferably in the range of about 3:1 to 6:1. The amount of catalyst utilized will generally range from about 0.1 weight percent to about 20 weight percent.

Suitable aluminosilicate catalysts include the aluminosilicate zeolites, which are generally employed as hydrated silicates of aluminum and either sodium or calcium, or both. The zeolite catalyst may be a natural zeolite or an artificial ion exchange resin. Typical zeolite catalysts which are useful for this process include the ZSM-5 type of zeolite catalyst, available from Mobil Chemical Company. ZSM-5 is a crystalline aluminosilicate zeolite having intermediate pore sizes. Other zeolites of the ZSM-5 type are also contemplated, such as ZSM-11. Other zeolite catalysts which may be employed include Linde LZY-20, available from Union Carbide, which is a crystalline aluminosilicate having a unit cell size of 24.37 Angstroms and a silica to alumina molar ratio of 5.6:1, Linde LZY-82, which is a crystalline aluminosilicate having a unit cell size of 24.56 Angstroms and a silica to alumina molar ratio of 5.4:1, and Linde SK-500, which is a crystalline aluminosilicate having a silica to alumina molar ratio of 4.9:1.

The aluminosilicate catalyst may also be any of the commercially available natural clays, which are generally hydrated aluminum silicates having a very fine particle size of irregularly shaped crystals. Typical clays which are useful as catalysts in this process include kaolin, montmorillonite, attapulgite, illite, bentonite, halloysite and mullite. A particularly suitable clay catalyst is Filtrol Grade 22 clay, available from Filtrol Corp., which is an aluminosilicate clay characterized as a highly activated adsorbent used for the low temperature decolorization of animal, vegetable and mineral oils.

The aluminosilicate catalyzed alkylation reaction will generally employ the same starting materials and can be carried out under the same reaction conditions as described above for the Friedel-Crafts catalyzed reaction of aniline and an olefin.

The alkylaniline produced by either the Friedel-Crafts or aluminosilicate catalyzed reaction of aniline with an olefin will normally contain a mixture of isomers, including ortho-, para- and N-substituted alkylaniline. In general, the ortho-substituted alkylaniline will be the predominant isomer.

The formaldehyde starting material is commercially available in three forms, namely, as an aqueous solution, as solid trioxane, and as solid paraformaldehyde. Although all three types of formaldehyde may be utilized in preparing the present co-oligomers, it is preferred to use aqueous formaldehyde.

The third component employed to form the co-oligomers of the invention is an aromatic compound selected from the group consisting of aniline, phenol, alkylphenol and ethoxylated alkylphenol.

In general, the alkyl side chain on the alkylphenol will contain from about 6 to 30 carbon atoms, preferably from about 9 to 18 carbon atoms, and more preferably from about 9 to 14 carbon atoms. Particularly preferred alkylphenols are nonylphenol and dodecylphenol. The alkylphenol may be readily obtained by conventional procedures. For example, the preparation of nonylphenol from propylene trimer and phenol using a p-toluenesulfonic acid monohydrate catalyst is described in W. A. Proell et al., Industrial and Engineering Chemistry, Volume 40, page 1129 (1948).

The ethoxylated alkylphenol employed to form the present co-oligomers may be represented by the following formula:

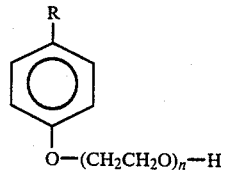

wherein R is alkyl of 6 to 24 carbon atoms, and n is an integer from 3 to 20. For the alkyl group, R, a preferred chain length is 9 to 18 carbon atoms, more preferably, 9 to 14 carbon atoms. Preferably, n will be an integer from 4 to 16. Suitable ethoxylated alkylphenols include ethoxylated hexylphenol, ethoxylated dodecylphenol and ethoxylated hexadecylphenol. Preferred ethoxylated alkylphenols are ethoxylated nonylphenol and ethoxylated tetradecylphenol.

The presently employed ethoxylated alkylphenols are generally prepared by conventional procedures known to the art. For example, the preparation of ethoxylated isooctylphenol or ethoxylated isododecylphenol is described in N. Schoenfeldt, "Surface Active Ethylene Oxide Adducts", page 106, Pergamon Press, 1969.

The alkylaniline, formaldehyde and aromatic compound are oligomerized using an acid catalyst, in a manner similar to the known acid-catalyzed condensation reaction of phenol and formaldehyde. The reaction temperature will generally be in the range of about 50° C. to 120° C., preferably in the range of about 70° C. to 100° C. The reaction pressure is generally ambient. An acid catalyst, such as hydrogen chloride, sulfuric acid, phosphoric acid, and the like, is employed in amounts ranging from about 0.1 to 50 percent by weight of the total reaction mixture. The reaction time is generally from 0.5 to 6 hours.

The molar ratio of formaldehyde to alkylaniline will normally range from about 0.8:1 to 4:1, preferably from about 1:1 to 1.8:1. When aniline is employed as a co-reactant, the molar ratio of aniline to alkylaniline will normally range from about 1:10 to 1:0.5, preferably, from about 1:5 to 1:1. When phenol is employed as a co-reactant, the molar ratio of phenol to alkylaniline will normally range from about 1:10 to 1:5, preferably from about 1:8 to 1:4. When alkylphenol is employed, the molar ratio of alkylphenol to alkylaniline will normally range from about 1:10 to 1:5, preferably from about 1:8 to 1:4. When an ethoxylated alkylphenol is employed, the molar ratio of ethoxylated alkylphenol to alkylaniline will normally range from about 1:2 to 1:100, preferably from about 1:5 to 1:50. After completion of the reaction, the co-oligomer is normally isolated as a solid product.

For use as corrosion inhibitors, the hydrocarbon-soluble oligomeric reaction products of the invention are applied to the metal surfaces to be protected in a variety of ways known to the art. For example, a dilute hydrocarbon solution of the co-oligomer may be contacted with the metal to be protected, using methods such as dipping, spraying, wiping, and the like. For this method of application, solutions of about 0.1 to 10%, preferably from about 0.2 to 1%, by weight of co-oligomer, or mixture of co-oligomer and other active corrosion inhibiting agents, are employed. The hydrocarbon solvent may be any of the known solvents, such as kerosene, diesel fuel, paint thinner, toluene, lubricating oil, and similar materials.

Alternatively, water-dispersible formulations of the present co-oligomers, or mixtures of the co-oligomers and other active corrosion inhibiting agents, can be added to a corrosive aqueous environment. In this method of application, sufficient amounts of co-oligomer, or mixture of the co-oligomer and other active corrosion inhibiting agents, are added to give from about 1 to 1000 ppm, preferably from 10 to 500 ppm, of active corrosion inhibitor in the final solution. Generally, the co-oligomer will be combined with a solvent and a surface-active agent to produce a concentrated solution of the corrosion inhibitor. In this solution, the co-oligomer, or mixture of the co-oligomer and other active corrosion inhibiting agents, will be present in amounts ranging from about 10 to 60%, preferably about 30 to 50%, by weight. The amount of solvent present is from about 30 to 80%, and the amount of surfactant is about 0 to 20%, by weight. This concentrated formulation is then diluted to the desired concentration of the final solution.

A typical water-dispersible formulation will contain about 15 to 30% of the present co-oligomer, about 15 to 30% of a dimer/trimer acid, about 0 to 8% of a nonionic surfactant, about 40 to 75% of a hydrocarbon solvent, such as kerosene, and about 0 to 5% of isopropanol.

Water-dispersible formulations of the present hydrocarbon-soluble co-oligomers are particularly useful in brine/$CO_2$ environments, such as encountered in oil wells employing secondary oil recovery techniques.

It has been found that, in comparison to simple oligomers of alkylaniline and formaldehyde, co-oligomers of the present invention, which contain up to 30 weight percent alkylphenol ethoxylate groups as an integral part of the co-oligomer structure, provide equally good protection against corrosion, but have greatly improved water dispersibility properties. This added feature is advantageous for applications in which the inhibitor formulation must be well dispersed in an aqueous phase during the inhibitor application process.

The following examples are provided to illustrate the invention in accordance with the principles of this invention but are not to be construed as limiting the invention in any way except as indicated by the appended claims.

EXAMPLES

EXAMPLE 1

Preparation of Tridecylaniline/aniline/formaldehyde Co-oligomer

The tridecylaniline used in this example was 90–95% para-substituted tridecylaniline, prepared from tridecylbenzene by nitration-hydrogenation. The tridecyl side chain was a mixture of several isomers, derived from propylene tetramer.

To a 250-ml, 3-necked flask, equipped with a magnetic stirrer, condenser and thermometer, was added 11.2 g (0.04M) tridecylaniline, 10 g water, 10 g concentrated HCl (0.104M), 6.48 g of 37% formaldehyde (0.08M) and 0.93 g aniline (0.01M). The reaction mixture was stirred for 2 hours at room temperature, followed by 2 hours at 80°-90° C. The mixture was cooled to room temperature and was neutralized with 91.4 g of 5% NaOH. The solid reaction product was separated from the liquids by decantation, washed with water and dissolved in methylene chloride. Part of the solid reaction product did not dissolve in methylene chloride and was filtered off and dried, yielding 0.3 g of insoluble polymer. Evaporation of the methylene chloride from the dissolved product gave 12.2 g of co-oligomer having a molecular weight of 880, as determined by vapor pressure osmometry. Nitrogen analysis of the co-oligomer showed 4.3% nitrogen.

EXAMPLES 2-13

Additional alkylaniline/aromatic compound/formaldehyde co-oligomers were prepared using essentially the same reaction conditions and procedure as in Example 1. The results are summarized in Table I.

TABLE I

| Example No. | Alkylaniline Wt., g | Alkylaniline Moles, M | Aromatic Compound Wt., g | Aromatic Compound Moles, M | Formaldehyde (37%) Wt., g | Formaldehyde (37%) Moles, M | Yield, g | Insolubles, g | Mol. Wt.[f] | % Nitrogen | Solubility Xylene | Solubility n-Heptane |
|---|---|---|---|---|---|---|---|---|---|---|---|---|
| | p-tridecylaniline[a] | | Aniline | | | | | | | | | |
| 1 | 11.2 | 0.04 | 0.93 | 0.01 | 6.5 | 0.08 | 12.2 | 0.3 | 880 | 4.3 | yes | yes |
| 2 | 12.6 | 0.045 | 0.47 | 0.005 | 6.5 | 0.08 | 14.6 | 0.10 | 1330 | 4.0 | yes | yes |
| 3 | 8.4 | 0.03 | 1.87 | 0.02 | 6.5 | 0.08 | 9.1 | 1.5 | 840 | 4.3 | yes | yes |
| 4 | 11.2 | 0.04 | 0.93 | 0.01 | 4.1 | 0.05 | 12.6 | 0.7 | 1150 | 4.4 | yes | yes |
| 5 | 8.4 | 0.03 | 1.87 | 0.02 | 4.1 | 0.05 | 8.6 | 1.1 | 1160 | 4.5 | yes | yes |
| | p-tridecylaniline[a] | | phenol | | | | | | | | | |
| 6 | 11.2 | 0.04 | — | 0.01 | 6.5 | 0.08 | 14.2 | 0 | 750 | 3.9 | yes | no |
| 7 | 8.4 | 0.03 | — | 0.02 | 6.5 | 0.08 | 11.0 | 0.5 | 1000 | 3.8 | yes | no |
| | p-dodecylaniline[b] | | p-dodecylphenol | | | | | | | | | |
| 8 | 65.3 | 0.25 | 67.0 | 0.25 | 65.0 | 0.8 | 152.0 | 0 | 670 | 2.4 | yes | yes |
| | p-dodecylaniline[b] | | ethoxylated p-nonylphenol[c] | | | | | | | | | |
| 9 | 65.3 | 0.25 | 30 | 0.048 | 65.0 | 0.8 | 100.0 | 0 | 520 | 3.5 | yes | no |
| 10 | 65.3 | 0.25 | 50 | 0.081 | 65.0 | 0.8 | 119.6 | 0 | 600 | 2.9 | yes | no |
| 11 | 65.3 | 0.25 | 70 | 0.113 | 65.0 | 0.8 | 140.0 | 0 | 620 | 2.6 | yes | no |
| | p-dodecylaniline[b] | | ethoxylated p-tetradecylphenol[d] | | | | | | | | | |
| 12 | 65.3 | 0.25 | 30 | 0.035 | 65.0 | 0.8 | 94.0 | 0 | 570 | 3.4 | yes | no |
| | p-dodecylaniline[b] | | ethoxylated p-tetradecylphenol[e] | | | | | | | | | |
| 13 | 65.3 | 0.25 | 30 | 0.054 | 65.0 | 0.8 | 91.6 | 0 | 550 | 3.3 | yes | yes |

[a]Prepared from tridecylbenzene by nitration-hydrogenation. The tridecyl side chain is derived from propylene tetramer and is a mixture of several isomers.
[b]90-95% Para-substituted deodecylaniline, obtained from Monsanto Company. The dodecyl side chain is derived from propylene tetramer and is a mixture of several isomers.
[c]Contains about 9 ethoxy groups per molecule.
[d]Contains about 13 ethoxy groups per molecule.
[e]Contains about 6 ethoxy groups per molecule.
[f]Vapor pressure osmometry (45° C., toluene).

In the following examples, the term "alkylaniline/formaldehyde oligomer" is used to designate an oligomer obtained by the acid-catalyzed oligomerization of alkylaniline and formaldehyde, such as described in commonly assigned, copending U.S. patent application Ser. No. 926,036, filed concurrently herewith, titled "Alkylaniline/Formaldehyde Oligomers as Corroson Inhibitors". Moreover, the term "alkylaniline/formaldehyde co-oligomer" is used to designate the co-oligomers of the present invention, obtained by the acid-catalyzed oligomerization of alkylaniline, formaldehyde and an aromatic compound as described herein.

EXAMPLE 14

Improved Dispersibility of Co-Oligomers Containing Alkylphenol Ethoxylate Groups To demonstrate the improved dispersibility characteristics of alkylaniline/formaldehyde co-oligomers containing alkylphenol ethoxylate surfactant structures as an integral part of the oligomeric molecule, versus a simple mixture of an alkylaniline/formaldehyde oligomer and an alkylphenol ethoxylate surfactant, the following test was conducted.

Two formulations were prepared, wherein Formulation 1 contained 25% of a dodecylaniline/formaldehyde oligomer, 25% of a dimer/trimer acid (Empol 1024), and 8% of a p-nonylphenol ethoxylate surfactant containing 9 ethoxy groups per molecule (Igepal CO-630), the remainder being a heavy aromatic naphtha solvent. Formulation 2 contained 25% of a dodecylaniline/formaldehyde co-oligomer incorporating 30 weight percent of a p-nonylphenol ethoxylate (Igepal CO-630) in the co-oligomeric product, 25% of a dimer/trimer acid (Empol 1024), and the remainder a heavy aromatic naphtha solvent. Then, a 100 mg sample of each formulation was added to 1 ml of distilled water, and the mixtures vigorously shaken to produce uniform aqueous dispersions of the two formulations. In Formulation 1, containing a simple mixture of dodecylaniline/formaldehyde oligomer and ethoxylate surfactant, the dispersion separated completely in approximately 30 minutes. Formulation 2, containing the dodecylaniline/formaldehyde/ethoxylate co-oligomer, remained well dispersed for over 4 hours. Since the weight percent of p-nonylphenol ethoxylate in these two formulations was essentially the same, the improved dispersibility of Formulation 2 was attributed to the chemical incorporation of the ethoxylate surfactant moiety into the oligomeric structure.

EXAMPLE 15

Comparison of Formulated Ethoxylate-containing Co-oligomer With Commercial Nalco Visco 4907 For $CO_2$ Corrosion Cleaned and degreased mild steel coupons were immersed in a synthetic seawater solution saturated with $CO_2$ gas at 90° C. and equilibrated for 18 hours. The instantaneous general corrosion rates were electrochemically measured using the standard linear polarization method to give the uninhibited corrosion rates for the test coupons, typically 100–150 mils per year (mpy) in this environment. To these solutions were then added sufficient amounts of formulated inhibitor to reach 100 ppm total formulation in the corrosion solution. Initial inhibited corrosion rates (CR) were measured using the linear polarization method 15 minutes after addition of the formulated inhibitor, and then monitored as a function of time. The percent inhibition was then calculated as follows:

% Inhibition=(Uninhibited CR - Inhibited CR)/Uninhibited CR

Comparisons were made with Nalco Visco 4907, a commercial nitrogen-containing corrosion inhibitor formulation. The commercial Nalco formulation was used as received. The dodecylaniline/formaldehyde/ethoxylated p-nonylphenol co-oligomer of Example 9 (Table I), containing 30 weight percent ethoxylated p-nonylphenol, was used in a formulation consisting of:

| | |
|---|---|
| Co-oligomer | 28.8% |
| Empol 1024 Dimer/Trimer Acid | 21.2% |
| Kerosene | 45.9% |
| Isopropanol | 4.2% |

The Empol 1024 dimer/trimer acid is a commercially available fatty acid oligomer. Following addition of the formulated inhibitors, the corrosion rate was monitored and the percent inhibition calculated as shown above.

Both inhibitor formulations quickly lowered the corrosion rate and provided significant inhibition. Following 18 hours, the inhibited corrosion rates had stabilized at 7 mpy for the Nalco formulation and at 2.5–3.5 mpy for the formulated co-oligomer.

EXAMPLE 16

Comparison of Formulated Ethoxylate-containing Co-oligomer With Formulated Simple Alkylaniline/formaldehyde Oligomer for $CO_2$ Corrosion Cleaned and degreased mild steel coupons were immersed in a synthetic seawater solution saturated with $CO_2$ gas at 90° C. and equilibrated for 18 hours. The instantaneous general corrosion rates were electrochemically measured using the standard linear polarization method to give the uninhibited corrosion rates for the test coupons, typically 100–150 mpy in this environment. To these solutions were then added sufficient amounts of formulated inhibitor to reach 100 ppm total formulation in the corrosion solution.

The simple alkylaniline/formaldehyde oligomer employed was a dodecylaniline/formaldehyde oligomer, which was used in a formulation consisting of:

| | |
|---|---|
| Dodecylaniline/formaldehyde oligomer | 25.3% |
| Empol 1024 Dimer/Trimer Acid | 24.7% |
| Nonionic Surfactant | 4.0% |
| Kerosene | 42.2% |
| Isopropanol | 3.8% |

The nonionic surfactant used in this formulation was Igepal CO-630, a p-nonylphenol ethoxylate containing 9 ethoxy groups per molecule.

The ethoxylate-containing co-oligomer employed was the dodecylaniline/formaldehyde/ethoxylated p-nonylphenol co-oligomer used in Example 15 and was formulated in the same formulation as described in Example 15. Following addition of the formulated inhibitors, the corrosion rate was monitored and the percent inhibition calculated according to the formula shown above.

Both inhibitor formulations quickly lowered the corrosion rate and provided significant inhibition. Following 18 hours, the inhibited corrosion rates had stabilized at 3.5 mpy for the simple oligomer formulation and at 2.5–3.5 mpy for the formulated co-oligomer. Thus, both structures provide excellent inhibition of corrosion, but the co-oligomer did not require the inclusion of any additional surfactant in the formulation, and provided a more water-dispersible formulation than the simple oligomer formulation.

EXAMPLE 17

Corrosion Inhibition with Co-oligomers Containing Varying Amounts of Alkylphenol Ethoxylate A series of ethoxylate-containing co-oligomers prepared with varying amounts of alkylphenol ethoxylate have been evaluated for their corrosion inhibition properties in continuous treatment tests such as the one described above. The alkylaniline co-oligomers contain varying amounts of one of three alkylphenol ethoxylate surfactants:

Ethoxylate A: A p-nonylphenol ethoxylate containing 9 ethoxy groups per molecule (Igepal CO-630)

Ethoxylate B: A p-tetradecylphenol ethoxylate containing 13 ethoxy groups per molecule Ethoxylate C: A p-tetradecylphenol ethoxylate containing 6 ethoxy groups per molecule Table II below lists the co-oligomer structures and the inhibited corrosion rates provided by 100 ppm of formulations of these materials. The first entry in Table II shows the simple oligomer of dodecylaniline and formaldehyde for comparison. The data in Table II shows that in 90° C. brine saturated with $CO_2$, all of the ethoxylate-containing co-oligomers are effective corrosion inhibitors. Those co-oligomers with about 30 weight percent ethoxylate provide inhibition comparable to that provided by the simple oligomer, although the water dispersibility of the co-oligomer is far superior to that of the simple oligomer. The corrosion rates listed are those attained 18 hours after inhibitor addition. Typical values for corrosion rates before inhibitor addition are 80–150 mpy.

TABLE II

| Dodecylaniline/Formaldehyde/Ethoxylate Co-Oligomer | Alkyl-aniline: Ethoxy-late Wt. Ratio | Cor-rosion Rate MPY |
|---|---|---|
| Dodecylaniline/Formaldehyde | 100:0 | 2–3.5 |
| Dodecylaniline/Formaldehyde/Ethoxylate B | 23:77 | 9 |
| Dodecylaniline/Formaldehyde/Ethoxylate B | 69:31 | 2–3 |
| Dodecylaniline/Formaldehyde/Ethoxylate C | 69:31 | 3 |
| Dodecylaniline/Formaldehyde/Ethoxylate A | 48:52 | 12–13 |
| Dodecylaniline/Formaldehyde/Ethoxylate A | 57:43 | 7–8 |
| Dodecylaniline/Formaldehyde/Ethoxylate A | 69:31 | 2.5–4 |

EXAMPLE 18

Comparison of Formulated Ethoxylate-containing Co-oligomer With Commercial Nalco Visco 4907 For $H_2S$ Corrosion Cleaned and degreased mild steel coupons were immersed in a synthetic seawater solution saturated with $H_2S$ gas at 90° C. and equilibrated for 18 hours. The instantaneous general corrosion rates were electrochemically measured using the standard linear polarization method to give the uninhibited corrosion rates for the test coupons, typically 75–125 mpy in this environment. To these solutions were then added sufficient amounts of formulated inhibitor to reach 100 ppm total formulation in the corrosion solution.

A comparison was made with Nalco Visco 4907, a commercial nitrogen-containing corrosion inhibitor formulation. The commercial Nalco formulation was used as received. The dodecylaniline/formaldehyde/p-tetradecylphenol ethoxylate co-oligomer of Example 12 (Table I), containing 30 weight percent ethoxylate, was used in a formulation similar to that shown in Example 15 above. Following addition of the formulated inhibitors, the corrosion rate was monitored and the percent inhibition calculated using the formula shown above.

Both inhibitor formulations quickly lowered the corrosion rate and provided significant inhibition. Following 18 hours, the inhibited corrosion rates had stabilized at 21 mpy for the Nalco formulation and at 11–12 mpy for the formulated co-oligomer.

What is claimed is:

1. A hydrocarbn-soluble corrosion inhibitor composition comprising the reaction product obtained by the acid-catalyzed oligomerization of (A) an alkylaniline having from 4 to 30 carbon atoms in the alkyl substituent, (B) formaldehyde, and (C) an aromatic compound selected from the group consisting of aniline, phenol, alkylphenol having from 6 to 30 carbon atoms in the alkyl substituent, and an ethoxylated alkylphenol of the formula

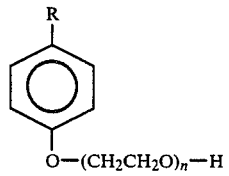

wherein R is alkyl of 6 to 24 carbon atoms, and n is an integer from 3 to 20.

2. The composition according to claim 1, wherein the alkylaniline has from 10 to 30 carbon atoms in the alkyl substituent.

3. The composition according to claim 2, wherein the alkylaniline has from 12 to 24 carbon atoms in the alkyl substituent.

4. The composition according to claim 3, wherein the alkylaniline is dodecylaniline.

5. The composition according to claim 3, wherein the alkylaniline is $(C_{20-24})$-alkylaniline.

6. The composition according to claim 1, wherein the aromatic compound is aniline.

7. The composition according to claim 1, wherein the aromatic compound is phenol.

8. The composition according to claim 1, wherein the aromatic compound is alkylphenol.

9. The composition according to claim 1, wherein the aromatic compound is an ethoxylated alkylphenol.

10. The composition according to claim 1, wherein the molar ratio of formaldehyde to alkylaniline is about 0.8:1 to 4:1.

11. The composition according to claim 10, wherein the molar ratio of formaldehyde to alkylaniline is about 1:1 to 1.8:1.

12. The composition according to claim 6, wherein the molar ratio of aniline to alkylaniline is about 1:10 to 1:0.5.

13. The composition according to claim 7, wherein the molar ratio of phenol to alkylaniline is about 1:10 to 1:5.

14. The composition according to claim 8, wherein the molar ratio of alkylphenol to alkylaniline is about 1:10 to 1:5.

15. The composition according to claim 9, wherein the molar ratio of ethoxylated alkylphenol to alkylaniline is about 1:2 to 1:100.

16. A method of inhibiting corrosion of a corrodible metal material which comprises contacting the metal material with an effective amount of a corrosion inhibitor composition comprising the reaction product obtained by the acid-catalyzed oligomerization of (A) an alkylaniline having from 4 to 30 carbon atoms in the alkyl substituent, (B) formaldehyde, and (C) an aromatic compound selected from the group consisting of aniline, phenol, alkylphenol having from 6 to 30 carbon atoms in the alkyl substituent, and an ethoxylated alkylphenol of the formula

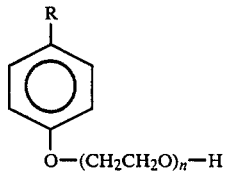

wherein R is alkyl of 6 to 24 carbon atoms, and n is an integer from 3 to 20.

17. The method according to claim 16, wherein the alkylaniline has from 10 to 30 carbon atoms in the alkyl substituent.

18. The method according to claim 17, wherein the alkylaniline has from 12 to 24 carbon atoms in the alkyl substituent.

19. The method according to claim 18, wherein the alkylaniline is dodecylaniline.

20. The method according to claim 18, wherein the alkylaniline is ($C_{20-24}$)-alkylaniline.

21. The method according to claim 16, wherein the aromatic compound is aniline.

22. The method according to claim 16, wherein the aromatic compound is phenol.

23. The method according to claim 16, wherein the aromatic compound is alkylphenol.

24. The method according to claim 16, wherein the aromatic compound is an ethoxylated alkylphenol.

25. The method according to claim 16, wherein the molar ratio of formaldehyde to alkylaniline is about 0.8:1 to 4:1.

26. The method according to claim 25, wherein the molar ratio of formaldehyde to alkylaniline is about 1:1 to 1.8:1.

27. The method according to claim 21, wherein the molar ratio of aniline to alkylaniline is about 1:10 to 1:0.5.

28. The method according to claim 22, wherein the molar ratio of phenol to alkylaniline is about 1:10 to 1:5.

29. The method according to claim 23, wherein the molar ratio of alkylphenol to alkylaniline is about 1:10 to 1:5.

30. The method according to claim 24, wherein the molar ratio of ethoxylated alkylphenol to alkylaniline is about 1:2 to 1:100.

31. A method of inhibiting corrosion of a corrodible metal material in or around a well through which a corrosive fluid is produced, which comprises contacting the metal material with an effective amount of a corrosion inhibitor composition comprising the reaction product obtained by the acid-catalyzed oligomerization of (A) an alkylaniline having from 4 to 30 carbon atoms in the alkyl substituent, (B) formaldehyde, and (C) an aromatic compound selected from the group consisting of aniline, phenol, alkylphenol having from 6 to 30 carbon atoms in the alkyl substituent, and an ethoxylated alkylphenol of the formula

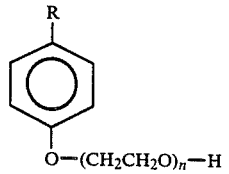

wherein R is alkyl of 6 to 24 carbon atoms, and n is an integer from 3 to 20.

32. A composition comprising (a) about 15 to 30% of the corrosion inhibitor composition of claim 1;

(b) about 15 to 30% of a dimer/trimer acid;

(c) about 0 to 8% of a nonionic surfactant;

(d) about 40 to 75% of a hydrocarbon solvent; and (e) about 0 to 5% of isopropanol.

* * * * *